US005819879A

United States Patent [19]

Lang et al.

[11] Patent Number: 5,819,879

[45] Date of Patent: Oct. 13, 1998

[54] SAFETY BRAKE

[75] Inventors: Michael C. Lang, Naugatuck; Dat T. Nguyen, West Hartford; Samuel C. Wan, Simsbury; Richard J. Ericson, Southington; Paul Bennett, Waterbury; Joseph A. L. LeDoux, Plantsville; Fred J. Lussier, Hebron; Philip H. McCluskey, Manchester; David W. McKee, Somers; James T. Beals, West Hartford; Mark S. Thompson, Tolland; Anthony Cooney, Unionville, all of Conn.

[73] Assignee: Otis Elevator Company, Farmington, Conn.

[21] Appl. No.: 965,181

[22] Filed: Nov. 6, 1997

[51] Int. Cl.[6] ..... B66B 5/04

[52] U.S. Cl. ..... 187/376; 157/370; 157/374; 157/375; 188/166

[58] Field of Search ..... 187/367, 370, 187/374, 375, 376; 188/59, 74, 184, 188, 166, 181 R

[56] References Cited

U.S. PATENT DOCUMENTS

| | | | |
|---|---|---|---|
| 530,971 | 12/1894 | Smith | 187/375 |
| 990,052 | 4/1911 | Koppell | 187/375 |
| 2,629,461 | 6/1953 | Moyer | 187/370 |
| 4,697,977 | 10/1987 | Loomer et al. | 187/367 |
| 5,503,257 | 4/1996 | Sugita et al. | 188/251 R |

FOREIGN PATENT DOCUMENTS

| | | |
|---|---|---|
| 2274827 | 8/1994 | United Kingdom . |
| 2287451 | 9/1995 | United Kingdom . |

*Primary Examiner*—David A. Bucci
*Assistant Examiner*—Thuy V. Tran
*Attorney, Agent, or Firm*—Francis J. Maguire, Jr.

[57] ABSTRACT

An elevator safety brake is provided comprising two cantilevers, a pivot, a spring, and a hold-off-engagement linkage. In one embodiment, the hold-off-engagement linkage is comprised of two upper struts, and two lower struts. When it is desired to slow or stop the elevator via the safety brake, the lower struts move from a first position in which the lower struts are substantially in alignment with one another and the cantilevers are in an open position, to a second position in which the lower struts are not substantially in alignment with one another and the cantilevers are in a closed position. When the cantilevers are in the closed position, the spring exerts a force via the cantilevers on the guide rail in order to decelerate the elevator.

10 Claims, 3 Drawing Sheets

FIG.2
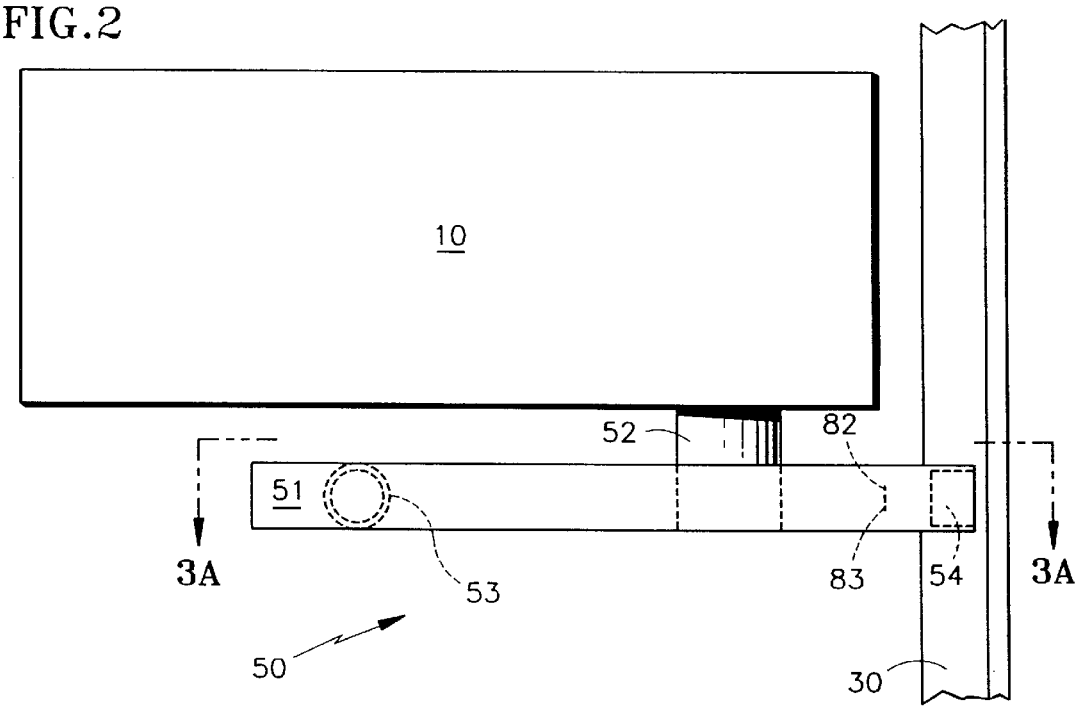
FIG.3A
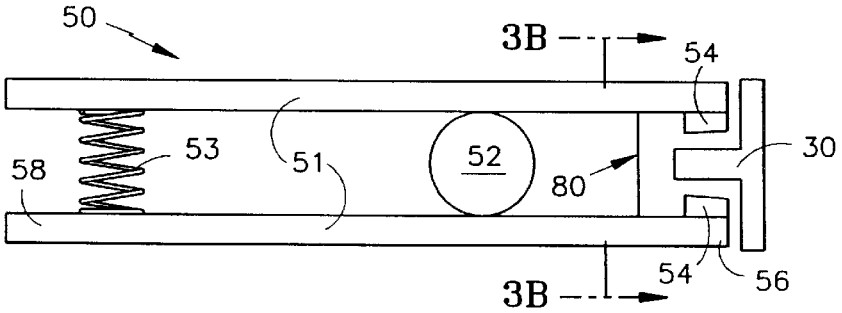
FIG.4A
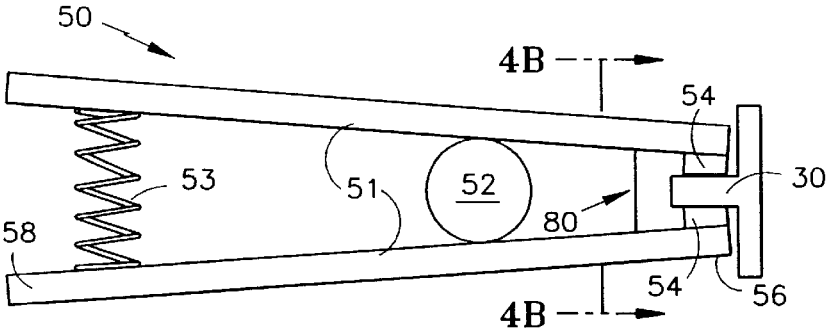
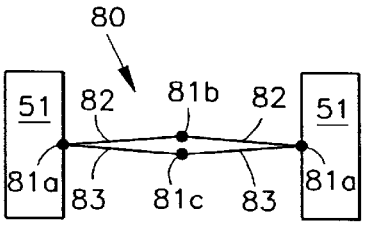
FIG.3B
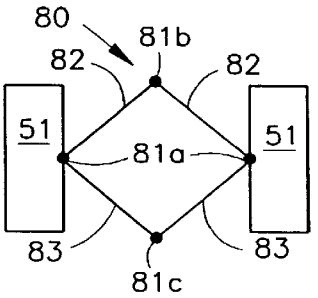
FIG.4B

SAFETY BRAKE

BACKGROUND OF THE INVENTION

1. Field of the Invention

The present invention relates generally to a safety braking system for slowing or stopping a vertically moving object, such as an elevator car or the counter-weight of an elevator car, in an emergency. In particular, the present invention relates to an elevator safety braking mechanism which engages brake pads on a guide rail in order to slow or stop an elevator car or the counter-weight associated with an elevator car.

2. Discussion of Related Art

In the prior art, elevators are equipped with a safety brake which is engaged against the guide rail when the elevator overspeeds. These prior art safety brakes are activated by a governor which permits the safety brake to engage a guide rail when the velocity of the elevator exceeds a predetermined rate.

An example of a prior art safety brake is shown in FIG. 1. The prior art safety brakes are generally comprised of brake shoes 20, spring 21 and cam surface 22. If a problem develops wherein the elevator's downward velocity must be reduced, brake shoes 20 are moved toward the car until the shoe contacts the guide rail 30. Once the brake shoes 20 engage guide rail 30, the brake shoes 20 become wedged between the rail 30 and cam surface 22. A normal force is applied to the shoe via spring 21.

The prior art safety brake shown in FIG. 1 has several disadvantages as compared to the present invention. First, since such prior art safety brakes rely on the downward motion of the car to wedge the brake shoes against the guide rail, such prior art safety brakes will not effectively stop an elevator or counter weight traveling in an upward or opposite direction of the wedge.

Second, such prior art safety brakes can not meet the criteria of some modern high-rise building designs. For example, it is desired to have a safety brake which is less than 450 mm (width)×650 mm (depth) and can accommodate an elevator having a load capacity of 16,000 kg and a normal operating speed of 15 m/s. The prior art safety brake systems cannot meet these criteria. Accordingly, there is a need for an elevator safety brake which can meet the criteria of modern high-rise buildings.

SUMMARY OF THE INVENTION

It is an object of the present invention to provide a safety brake for an elevator system which will reduce the velocity of an elevator car or the counter-weight associated with an elevator car in both directions of travel, either the upward or downward direction.

It is also an object of the present invention to provide a safety brake for an elevator system which has more braking force than prior art safety brakes of similar size.

These objects are accomplished, at least in part, by an elevator safety brake for decelerating an elevator car, such brake having: a pivot attached to the elevator car; a first cantilever having a rail end and a lever end and a friction surface at the rail end, and wherein the first cantilever is positioned adjacent to the pivot between its rail and lever ends; a second cantilever having a rail end and a lever end and a friction surface at the rail end, and wherein the second cantilever is positioned adjacent to the pivot between its rail end and its lever end and is further positioned so that its friction surface is opposed to the friction surface of the first cantilever; and a means for applying a force between the lever ends of the first and second cantilevers to cause the cantilevers to rotate about the pivot so as to cause the friction surfaces to move towards each other. The brake is further provided with a releasable means for preventing the first and second cantilevers from rotating about the pivot.

Other objects and advantages of the present invention will become apparent to those skilled in the art from the following detailed description read in conjunction with the attached drawings and claims appended hereto.

BRIEF DESCRIPTION OF THE DRAWINGS

The drawings, not drawn to scale, include:

FIG. 2, which is a side view of the safety brake of the present invention;

FIG. 3A, which is a top view taken along section line A—A in FIG. 2 of the safety brake of the present invention in the open position;

FIG. 3B, which is a view as indicated by section line B—B in FIG. 3A of the safety brake of the present invention, showing in more detail the hold-off-engagement linkage when the cantilevers are in the off position;

FIG. 4A, which is a top view taken along section line A—A in FIG. 2 of the safety brake of the present invention in the engaged position;

FIG. 4B, which is a view as indicated by section line B—B in FIG. 4A of the safety brake of the present invention, showing in more detail the hold-off-engagement linkage when the cantilevers are in the engaged position;

DETAILED DESCRIPTION OF THE INVENTION

Figure 1:
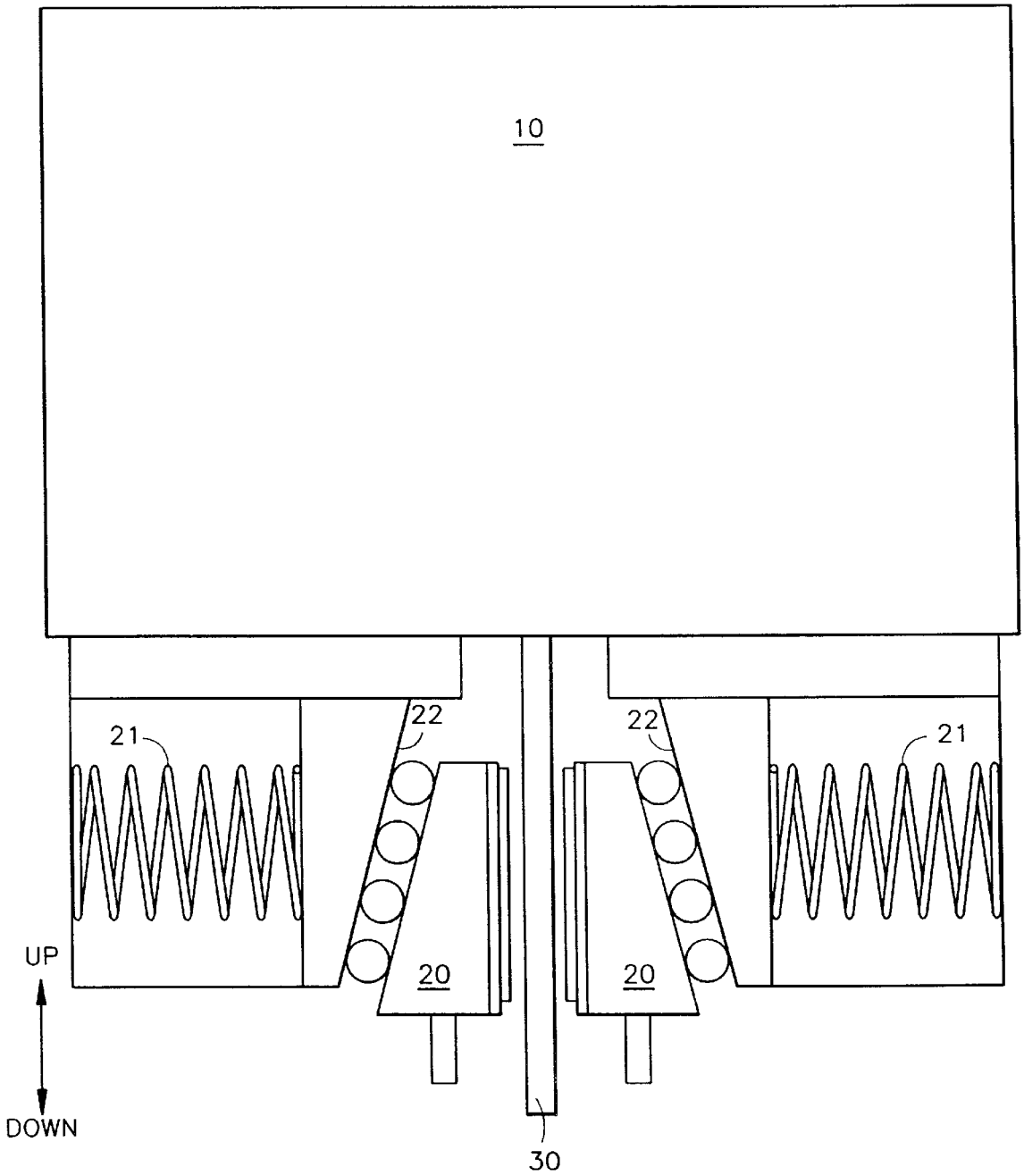
FIG.1 prior art
FIG. 1, which is a front view of a prior art safety brake.

Turning now to the drawings, in FIG. 2 there is shown a lower member of an elevator car 10, guide rail 30, and the safety brake 50 of the present invention. The safety brake 50 shown in FIG. 2 is further illustrated in FIGS. 3A, 3B, 4A, 4B, 5A and 5B. As shown in FIGS. 2 and 3A, the safety brake of the present invention is comprised of two cantilevers 51, each having a rail end 56 and a lever end 58. The brake further includes a pivot 52 which is attached to the car 10. The cantilevers 51 are positioned about the pivot 52 between their rail ends 56 and their lever ends 58. The brake also includes a spring 53 which is positioned between the cantilevers 51 and on the part of the cantilevers 51 between the lever end 58 and the pivot 52. Each of the cantilevers 51 is provided with a brake pad 54 positioned at the rail end 56. A hold off 80 is provided between the pivot 52 and rail end 56.

In FIG. 3A, the safety brake is shown in the off position in which the brake pads 54 do not engage the guide rail 30.

In this off position, the elevator car 10 is free to move as directed by the elevator's control system. When the rail end 56 of the cantilevers 51 are apart and the brake is in the off position, spring 53 is compressed between the cantilevers, thereby exerting a force on the cantilevers 51 at a position between their lever ends and the pivot 52. Despite the force on the cantilevers 51 exerted by spring 53, the rail end 56 of the cantilevers 51 are held apart in the off position by the hold-off-engagement linkage 80.

Preferably, as shown in FIG. 3B, hold-off-engagement linkage 80 is formed by a frame having upper struts 82 which are connected to the cantilevers 51 via hinges 81*a* and to each other via hinge 81*b*. The frame also includes lower struts 83 which are connected to the cantilevers 51 by hinges 81*a* and to each other via hinge 81*c*. Hinge 81*c* is connected to a tripping mechanism (not shown). When the rail ends 56 of the cantilevers 51 are in the apart position, the upper struts 82 are substantially aligned with each other, and similarly, lower struts 83 are substantially aligned with each other. When the upper struts 82 and the lower struts 83 are substantially aligned, they exert a force on the cantilevers 51 sufficient to keep the rail ends 56 apart and in the off position.

When it is desired to decelerate the elevator car 10, the hold-off-engagement linkage 80 is tripped or released by providing a pulling force on hinge 81*c*. This pulling force is usually provided by a governor (not shown). The pulling force causes hinges 81*b* and 81*c* to separate substantially from each other which, in turn, causes the lower struts 83 and the upper struts 82 to become out of alignment with each other. When the lower struts 83 are not substantially aligned with each other, they no longer exert a force on the rail end of the cantilevers 51 sufficient to balance the force exerted by spring 53. Thus, the spring 53 causes the cantilevers 51 to rotate towards the rail so that the rail ends 56 of the cantilevers 51 engage the rail 16 as shown in FIG. 4A.

Figure 5A:
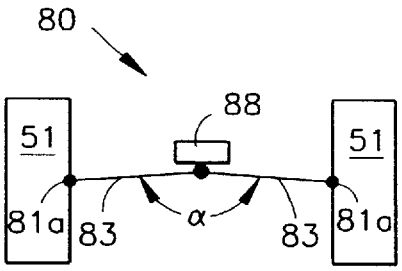
FIG. 5A, which is a view as indicated by section line B—B in FIG. 3A of the safety brake of the present invention, showing an alternative embodiment of the hold-off-engagement linkage when the cantilevers are in the off position.
Figure 5B:
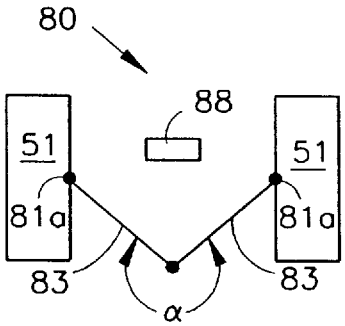
FIG. 5B, which is a view as indicated by section line B—B in FIG. 4A of the safety brake of the present invention, showing an alternative embodiment of the hold-off-engagement linkage when the cantilevers are in the engaged position.
Figure 5C:
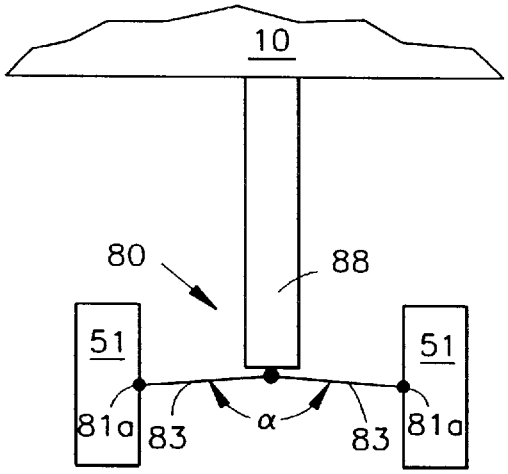
FIG. 5C, which is a view of the safety brake of the present invention, showing the brace 88 attached to the car 10.
Figure 5D:
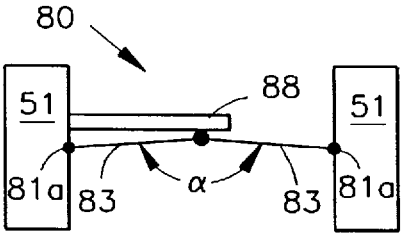
FIG. 5D, which is a view of the safety brake of the present invention showing the brace 88 attached to the cantilever 51.

In an alternative embodiment of the hold-off-engagement linkage 80 shown in FIGS. 5A and 5B, the upper struts are omitted and a brace 88 is added. The brace 88 may be (but need not be) attached to the car 10 (see FIG. 5C) or the cantilever 51 (see FIG. 5D). In the off position, one or both of lower struts 83 rest against the brace 88 forming angle $\alpha$ between the struts which is less than 180°. Brace 88 limits the hinging movement of the lower struts 83. The struts, resting on the brace 88, provide a force which opposes the force provided by the spring 53 acting on the lever end of the cantilevers 51. As shown in FIG. 5B, the hold-off-engagement linkage is released when the governor pulls hinge 81*c* away from the brace 88 so that angle $\alpha$ becomes greater than 180°. Once angle $\alpha$ is greater than 180° the struts 83 are no longer capable of providing a force which opposes the force applied by the spring 53.

It will be recognized to those skilled in the art that the relative position of spring 53, pivot 52 and brake pads 54 can be adjusted to arrive at the desired braking force to be exerted on the guide rail 30 when the cantilevers 51 are in the engaged position. In addition, those skilled in the art will recognize that spring 53 can be designed to exert a wide range of braking forces. It should be noted however, that the preferred type of spring is a coil spring because a coil spring efficiently utilizes the space between the cantilevers 51 so as to reduce the space required by the safety brake 50. It should be noted that although the invention has been described as utilizing a coil spring 53, any means for applying a force between the lever ends of the cantilevers 51 to cause the cantilevers to rotate about the pivot may be used. In addition to the wide range of brake forces which can be used, the safety brake 50 of the present invention can be designed to meet the criteria of a modern high-rise building.

Although the present invention has been described in conjunction with stopping an elevator car, it should be noted that the safety brake of the present invention can also be used in conjunction with a counter-weight associated with an elevator car.

Although the present invention has been described with respect to one or more particular embodiments of the apparatus, it will be understood that other embodiments of the present invention may be made without departing from the spirit and scope of the present invention. Hence, the present invention is deemed limited only by the appended claims and the reasonable interpretation thereof.

What is claimed is:

1. An elevator safety brake for decelerating an elevator car, comprising:

a pivot attached to the elevator car;

a first cantilever having a rail end and a lever end, and having a friction surface at the rail end, and wherein the first cantilever is positioned adjacent to the pivot between its rail and lever ends;

a second cantilever having a rail end and a lever end, and having a friction surface at the rail end, and wherein the second cantilever is positioned adjacent to the pivot between its rail end and its lever end and is further positioned so that its friction surface is opposed to the friction surface of the first cantilever;

means for applying a force between the lever ends of the first and second cantilevers to cause the cantilevers to rotate about the pivot;

releasable means for applying a force to prevent the first and second cantilevers from rotating about the pivot, wherein said releasable means is positioned between the rail ends of the first and second cantilevers and the pivot.

2. The brake of claim 1 wherein the means for applying a force is located between the cantilevers.

3. The brake of claim 2 wherein the means for applying a force is also located between the pivot and the lever ends.

4. The brake of claim 1 wherein the means for applying a force is a coil spring.

5. The brake of claim 1 wherein the releasable means comprises a hold-off-engagement linkage having:

a first upper strut, having a cantilever-end and a strut-end, the cantilever-end of the first upper strut being hingedly connected to the first cantilever;

a second upper strut, having a cantilever-end and a strut-end, the cantilever-end of the second upper strut being hingedly connected to the second cantilever, and the strut-end of the second upper strut being hingedly connected to the strut-end of the first upper strut;

a first lower strut, having a cantilever-end and a strut-end, the cantilever-end of the first lower strut being hingedly connected to the first cantilever;

a second lower strut, having a cantilever-end and a strut-end, the cantilever-end of the second lower strut being hingedly connected to the second cantilever, and the strut-end of the second lower strut being hingedly connected to the strut-end of the first lower strut.

6. The brake of claim 5 wherein the means for applying a force is a coil spring.

7. The brake of claim 1 wherein the releasable means comprises a hold-off-engagement linkage having:

a first strut, having a cantilever-end and a strut-end, the cantilever-end of the first strut being hingedly connected to the first cantilever;

a second strut, having a cantilever-end and a strut-end, the cantilever-end of the second strut being hingedly connected to the second cantilever, and the strut-end of the second strut being hingedly connected to the strut-end of the first strut; and means for limiting hinging movement between the strut-end of the first strut and the strut-end of the second strut.

8. The brake of claim 7 wherein the means for applying a force is a coil spring.

9. The brake of claim 7 wherein the means for limiting the hinging movement is attached to the elevator car.

10. The brake of claim 7, wherein the means for limiting the hinging movement is attached to one of the cantilevers.

* * * * *